US008639099B2

(12) United States Patent
Morimoto et al.

(10) Patent No.: US 8,639,099 B2
(45) Date of Patent: Jan. 28, 2014

(54) TRAIN-MOUNTED VIDEO INFORMATION DISTRIBUTION AND DISPLAY SYSTEM AND DISPLAY SWITCHING METHOD THEREOF

(75) Inventors: Kazunari Morimoto, Chiyoda-ku (JP); Masao Oki, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 50 days.

(21) Appl. No.: 13/132,449

(22) PCT Filed: Dec. 25, 2008

(86) PCT No.: PCT/JP2008/073641
§ 371 (c)(1),
(2), (4) Date: Jun. 2, 2011

(87) PCT Pub. No.: WO2010/073351
PCT Pub. Date: Jul. 1, 2010

(65) Prior Publication Data

US 2011/0235989 A1 Sep. 29, 2011

(51) Int. Cl.
*H04N 5/93* (2006.01)

(52) U.S. Cl.
USPC ..... 386/353; 386/219

(58) Field of Classification Search
None
See application file for complete search history.

(56) References Cited

U.S. PATENT DOCUMENTS

2002/0032503 A1 3/2002 Maruyama et al.
2005/0192720 A1 9/2005 Christie et al.
2007/0100698 A1 5/2007 Neiman et al.
2007/0116227 A1* 5/2007 Vitenson et al. ..... 379/207.02

(Continued)

FOREIGN PATENT DOCUMENTS

EP 1 187 085 A2 3/2002
EP 1 313 319 A2 5/2003

(Continued)

OTHER PUBLICATIONS

Office Action (Decision of a Patent Grant) dated Jul. 17, 2012, issued in corresponding Japanese Patent Application No. 2007-179889, and an English Translation thereof. (4 pages).

(Continued)

*Primary Examiner* — Huy T Nguyen
*Assistant Examiner* — Eileen Adams
(74) *Attorney, Agent, or Firm* — Buchanan Ingersoll & Rooney PC

(57) ABSTRACT

A train-mounted video information distribution and display system sufficiently increases an advertising effect of advertisement videos that are broadcast in a train. A train-mounted video information distribution and display system includes: a display-program determining unit that extracts one or more pieces of video information from plural pieces of video information and determines a display program to be displayed on a display device; a video-information storing unit that holds video information, and reference information that is necessary to determine a display program; a display-program storage unit that receives a display program which is determined by the display-program determining unit from the video-information storing unit and holds the display program; and a distribution control unit that sequentially reads out display programs stored in the display-program storage unit and distributes the read display programs to the display device. The determined display program includes one or more pieces of video information that are determined based on segmentation information for assigning a predetermined section within a running section of a train, and the determined one or more pieces of video information are repeatedly displayed in the predetermined section.

11 Claims, 7 Drawing Sheets

(56) References Cited

U.S. PATENT DOCUMENTS

| | | | | |
|---|---|---|---|---|
| 2007/0130019 | A1* | 6/2007 | Ido et al. | 705/26 |
| 2007/0130030 | A1* | 6/2007 | Bookstaff | 705/27 |
| 2007/0152850 | A1* | 7/2007 | Pechenick et al. | 340/988 |
| 2007/0226762 | A1* | 9/2007 | Girgis et al. | 725/33 |
| 2008/0318559 | A1* | 12/2008 | Porco | 455/414.2 |
| 2009/0240590 | A1* | 9/2009 | Or et al. | 705/14.58 |

FOREIGN PATENT DOCUMENTS

| | | | |
|---|---|---|---|
| JP | 8-69268 | A | 3/1996 |
| JP | 2001-312238 | A | 11/2001 |
| JP | 2002-087267 | A | 3/2002 |
| JP | 2002-87268 | A | 3/2002 |
| JP | 2002-127905 | A | 5/2002 |
| JP | 2002-152156 | A | 5/2002 |
| JP | 2002-251159 | A | 9/2002 |
| JP | 2002-297075 | A | 10/2002 |
| JP | 2003-157035 | A | 5/2003 |
| JP | 2004-138765 | A | 5/2004 |
| JP | 2005-222335 | A | 8/2005 |
| JP | 2005-353054 | A | 12/2005 |
| JP | 2008-139616 | A | 6/2008 |
| JP | 2008-160204 | A | 7/2008 |
| TW | 318640 | | 10/1997 |

OTHER PUBLICATIONS

Office Action (Notice of Rejection) dated Jan. 31, 2012, issued by the Japanese Patent Office in the corresponding Japanese Patent Application No. 2007-179889 and an English Translation of Office Action. (6 pages).

Office Action dated Apr. 14, 2011, issued in the corresponding Taiwanese Patent Application No. 098100311.

International Search Report (PCT/ISA/210) issued on Jan. 27, 2009, by Japanese Patent Office as the International Searching Authority for International Application No. PCT/JP2008/073641.

Written Opinion (PCT/ISA/237) issued on Jan. 27, 2009, by Japanese Patent Office as the International Searching Authority for International Application No. PCT/JP2008/073641.

The Extended Search Report from European Patent Office dated on Mar. 12, 2013, issued in corresponding European Patent Application No. 08879147.0.

Office Action from Canadian Patent Office dated Dec. 5, 2012, issued in correcponding Canadian patent application No. 2,748,239.

Office Action from Chinese Patent Office dated Aug. 14, 2013, issued in corresponding Chinese Patent Application No. 200880132561.X, with English translation thereof. (12 pages).

* cited by examiner

| DISPLAY ORDER (X) | ADVERTISEMENT VIDEO NAME | AREA DETERMINATION CODE |
|---|---|---|
| 1 | ADVERTISEMENT VIDEO OF COMPANY A | 01 |
| 2 | ADVERTISEMENT VIDEO OF COMPANY B | 01 |
| 3 | ADVERTISEMENT VIDEO OF COMPANY C | 02 |
| 4 | ADVERTISEMENT VIDEO OF COMPANY D | 03 |
| 5 | ADVERTISEMENT VIDEO OF COMPANY E | 04 |
| 6 | ADVERTISEMENT VIDEO OF COMPANY F | 04 |

DISPLAY ORDER

| KILOMETRAGE (km) | AREA NUMBER |
|---|---|
| 0 TO 5 | 01 |
| 5 TO 10 | 01 |
| 10 TO 14 | 02 |
| 14 TO 20 | 03 |
| 20 TO 24 | 03 |
| 24 TO 31 | 04 |

FIG.9

| LAST STATION | NEXT STATION | AREA NUMBER |
|---|---|---|
| STATION ○○ | STATION ○△ | 01 |
| ○△ | △△ | 01 |
| △△ | □○ | 02 |
| □○ | ○● | 03 |
| ○● | ○◆ | 03 |
| ○◆ | ●× | 04 |

FIG.10

| NUMBER OF PASSENGERS | SEGMENTATION NUMBER |
|---|---|
| 0 TO 20 | 01 |
| 20 TO 50 | 02 |
| 50 TO 80 | 03 |
| 80 TO 100 | 04 |
| 100 TO 120 | 05 |
| EQUAL TO OR LARGER THAN 120 | 06 |

FIG.11

| TEMPERATURE (°C) | SEGMENTATION NUMBER |
|---|---|
| EQUAL TO OR LOWER THAN -10 | 01 |
| -10 TO 0 | 02 |
| 0 TO 10 | 03 |
| 10 TO 20 | 04 |
| 20 TO 30 | 05 |
| EQUAL TO OR HIGHER THAN 30 | 06 |

TRAIN-MOUNTED VIDEO INFORMATION DISTRIBUTION AND DISPLAY SYSTEM AND DISPLAY SWITCHING METHOD THEREOF

TECHNICAL FIELD

The present invention relates to a train-mounted video information distribution and display system that provides video information to passengers in passenger compartments, and a display switching method thereof.

BACKGROUND ART

In recent years, because of diversification of life patterns and behavioral patterns of people, advertisements by mass media and the like give enormous influences to these people with diversified life patterns. Furthermore, people yearn for obtaining new information, due to popularization of the Internet in recent years. For example, an advertisement video that is shown or displayed in a train is expected to have a significant advertising effect. Particularly, because the inside of a train is a confined space and also because actions of passengers are limited, the advertising effect is considered to be particularly significant, and the demand for advertisement videos is rapidly increasing.

Conventionally, there have been various patent publications concerning advertisement videos displayed in a train. For example, Patent Document 1 mentioned below discloses a technique of performing display control of determining whether to display information concerning a new interruption depending on the presence and a priority of interruption display information such as a kilometrage display, a display of door opening/closing, an emergency message display, a real-time information display, to provide a train-mounted video information distribution and display system that can securely provide various kinds of video information to passengers in passenger compartments with a simple configuration, without depending on an artificial operation by an operator and the like.

Patent Document 1: Japanese Patent Application Laid-open No. 2002-127905

DISCLOSURE OF INVENTION

Problem to be Solved by the Invention

However, according to conventional techniques including that described in Patent Document 1 mentioned above, information changed in real time is interruption information from which any advertising effect is not expected. On the other hand, concerning video information from which an advertising effect is expected, only video information stored in a storage device in advance is repeatedly displayed. This has a problem that the attention degree of passengers in a train to the video information becomes lower as time passes, and the advertising effect becomes lower accordingly.

Meanwhile, to increase the advertising effect, there has been considered a method of broadcasting many pieces of video information by preparing them in advance. In this case, it is necessary to set and reset priorities of video information and interruption information each time when video information is added. Therefore, when video information is frequently added and updated, there is a problem that the cost required to prepare the video information increases and the maintainability and serviceability are reduced.

The present invention has been achieved in view of the above problems, and an object of the present invention is to provide a train-mounted video information distribution and display system capable of sufficiently increasing an advertising effect of advertisement videos to be broadcast in a train and suppressing reduction of the maintainability and serviceability, and to provide a display switching method of the system.

Means for Solving Problem

In order to solve the above problem and in order to attain the above object, in a train-mounted video information distribution and display system that displays a plurality of pieces of video information as advertisement videos on a display device in a train based on train information of a given train that is obtained from a train information device mounted in the train, the system of the present invention includes: a display-program determining unit that extracts one or more pieces of video information from the pieces of video information and determines a display program to be displayed on the display device; a video-information storing unit that holds the video information and reference information that is necessary to determine the display program; a display-program storage unit that receives a display program which is determined by the display-program determining unit from the video-information storing unit, and holds a received display program; and a distribution control unit that sequentially reads out display programs stored in the display-program storage unit and distributes the read display programs to the display device. Additionally, the display program includes one or more pieces of video information that are determined based on segmentation information for assigning a predetermined section within a running section of the train, and the determined one or more pieces of video information are repeatedly displayed in the predetermined section.

Effect of the Invention

According to the train-mounted video information distribution and display system of the present invention, display programs, each including one or more pieces of video information that are determined based on segmentation information for assigning a predetermined section within a running section of a train, are sequentially read out and distributed to a display device. With this configuration, the determined one or more pieces of video information are repeatedly displayed in the predetermined section. Consequently, an advertising effect of advertisement videos broadcast in the train can be sufficiently increased, and thus reduction of the maintainability and serviceability can be suppressed.

BRIEF DESCRIPTION OF DRAWINGS

FIG. 9 is an example of a determination table for determining an area number by using information of a last station and a next station.

FIG. 10 is an example of a determination table in which information of "number of passengers" is used as a status.

FIG. 11 is an example of a determination table in which information of "temperature" is used as a status.

EXPLANATIONS OF LETTERS OR NUMERALS

Figure 1:
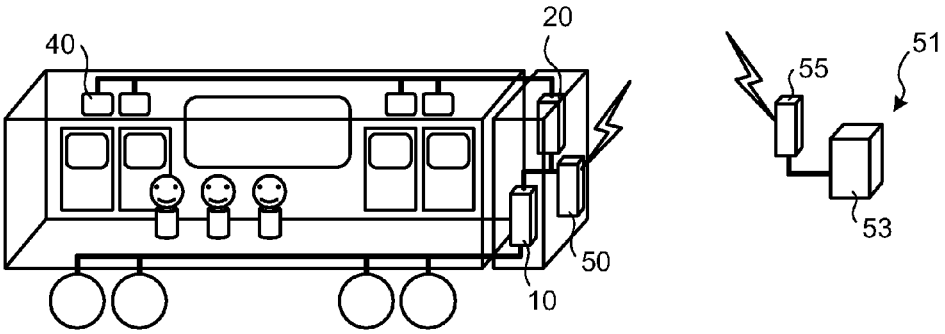
FIG. 1 is an explanatory diagram of a schematic image of a train-mounted video information distribution and display system according to a first embodiment of the present invention.

10 train information device
10*a* train identification information
10*b* train position information
10*c* train operation information
10*d* train current-status information
10*e* train instruction information
10*f* weather information
20 video-information distribution device
21 display-program determining unit
22 distribution control unit
24 video-information storing unit
25 display-program storage unit
28, 30 transmission path
31 branching device
32 terminating device
33 amplifying device
40 display device
50, 55 transmitting/receiving device
51 ground station
53 information processing device

BEST MODE(S) FOR CARRYING OUT THE INVENTION

Exemplary embodiments of a train-mounted video information distribution and display system and a display switching method thereof according to the present invention will be explained below in detail with reference to the accompanying drawings. The present invention is not limited to the embodiments.

First Embodiment (System Configuration)

Figure 2:
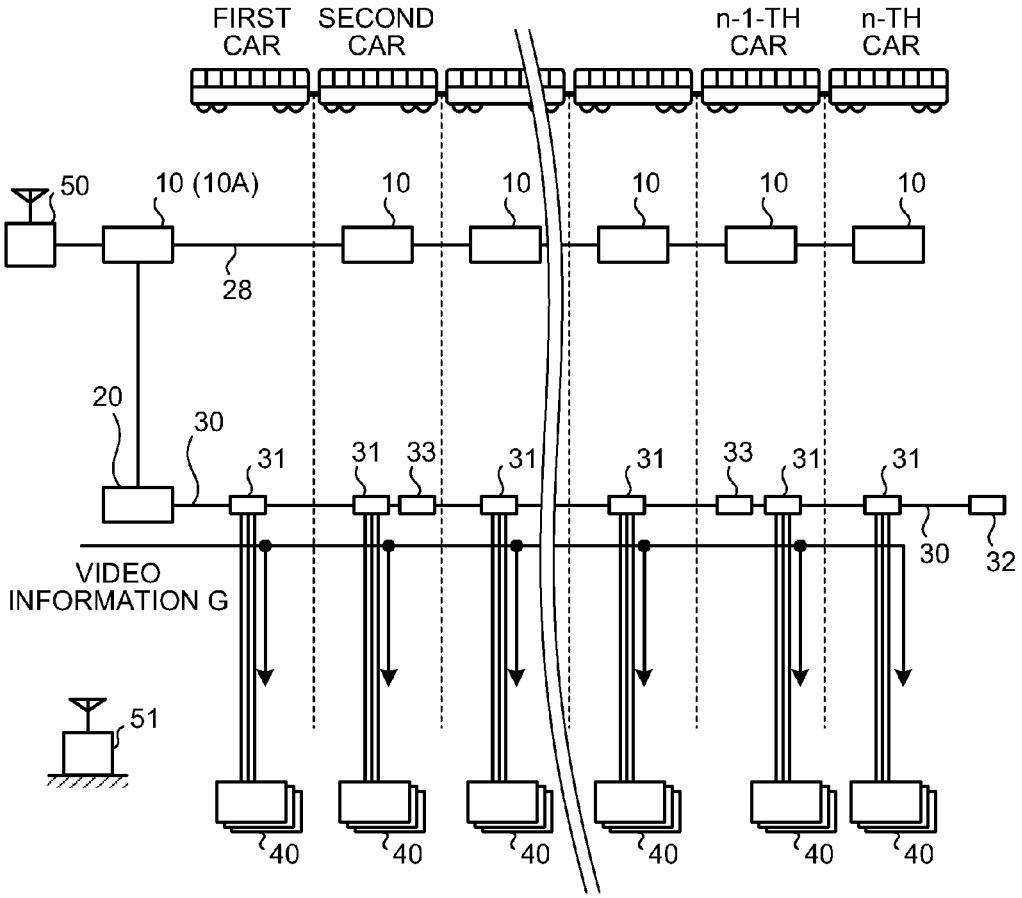
FIG. 2 depicts an overall system configuration of the train-mounted video information distribution and display system according to the first embodiment of the present invention.

First, a configuration of a train-mounted video information distribution and display system according to a first embodiment of the present invention is explained with reference to FIGS. 1 and 2. FIG. 1 is an explanatory diagram of a schematic image of the train-mounted video information distribution and display system according to the first embodiment of the present invention. FIG. 2 depicts an overall system configuration of the train-mounted video information distribution and display system according to the first embodiment of the present invention.

The train-mounted video information distribution and display system according to the present embodiment is applied to a train constituted by plural vehicles (first car to n-th car). A train side includes a train information device 10, a video-information distribution device 20, a display device 40, a transmitting/receiving device 50 or the like. A way side includes an information processing device 53 and a transmitting/receiving device 55 that constitute a ground station 51.

The train information device 10 processes train identification information 10*a* that includes a train number for identifying a train, train position information 10*b* including kilometrage from a departing station and an area number that shows a running area of a train, train operation information 10*c* including stopping-station information and an estimated time of arrival, train current-status information 10*d* including an arrival time and the number of passengers, train instruction information 10*e* including a door opening/closing instruction, a stopping instruction or the like, and weather information 10*f* including temperature information, atmospheric pressure information, and weather information. The train information device 10 of a leading car is connected to various control-operation devices (not shown) such as a master controller, and performs an input/output process of various kinds of information described above. The train information devices 10 that are mounted in vehicles are connected to each other via transmission paths 28 that are provided between the vehicles, and share train information by performing mutually the same operation. Various pieces of information relevant to a train including the train identification information 10*a*, the train position information 10*b*, the train operation information 10*c*, the train current-status information 10*d*, the train instruction information 10*e*, and the weather information 10*f* are collectively called "train information".

The video-information distribution device 20 is mounted in a leading car (the first car), for example, and is connected to a train information device 10 (10A) of this vehicle to input train information and output necessary video information. Details of the video-information distribution device 20 are described later. A branching device 31 and an amplifying device 33 are provided between the video-information distribution device 20 and the display device 40 that is provided in each vehicle, and a terminating device 32 is provided at a rear-end portion of a last vehicle. These devices are connected to each other via a transmission path 30. The transmission path 30 transmits an output signal (hereinafter, "video-information distribution signal") that includes video information G from the video-information distribution device 20 to each vehicle. The branching device 31 causes a signal that flows in the transmission path 30 to be branched to the display device 40 that is provided in each vehicle. The terminating device 32 prevents the video-information distribution signal that flows in the transmission path 30 from being reflected at a terminal end of the transmission path 30. The amplifying device 33 prevents the video-information distribution signal that flows in the transmission path 30 from being attenuated. Plural display devices 40 are provided in each vehicle as shown in the drawings. The transmitting/receiving device 50 is connected to the train information device 10 (10A), inputs information from a ground station 51 side by air, and outputs the information to the video-information distribution device 20. The transmitting/receiving device 50 can be also directly connected to the video-information distribution device 20. In this case, information that becomes necessary at a train information device 10 side is transmitted via the video-information distribution device 20.

(Configuration of the Video-Information Distribution Device 20)

Figure 3:
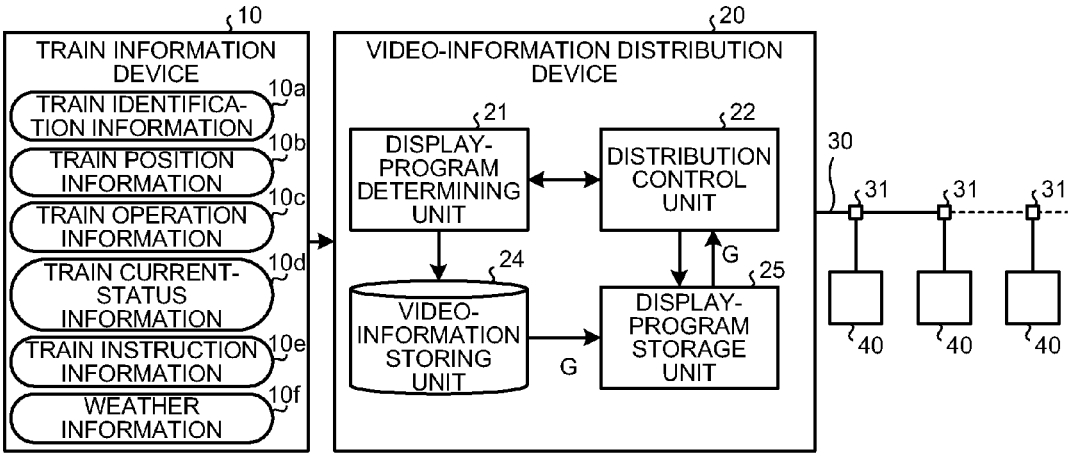
FIG. 3 is a block diagram mainly depicting a configuration of a video-information distribution device shown in FIG. 2.

FIG. 3 is a block diagram mainly depicting a configuration of the video-information distribution device 20 shown in FIG. 2. In FIG. 3, the video-information distribution device 20 includes: a display-program determining unit 21 that automatically determines a display program; a video-information storing unit 24 that stores video information that becomes a source of a display program, reference information (reference table) that is necessary to determine a display program, route information that is necessary to understand a running position and a running section of a train or the like; a display-program storage unit 25 that stores a display program that is determined by the display-program determining unit 21; and a distribution control unit 22 that controls distribution of a display program stored in the display-program storage unit 25 to the display device 40, which is provided in each vehicle.

In the following explanations, it is assumed that video information and reference information that are necessary for the display-program determining unit 21 to determine a display program are stored in the video-information storing unit 24, and that train information that is necessary to determine a display program is obtained from the train information device 10. Needless to mention, an assumption is not limited to these examples. For example, train information can be occasionally stored in the video-information storing unit 24. On the contrary, video information that becomes a display program can be received from the ground station 51 via the transmitting/receiving device 50. In the case of this example, preferably, the video-information distribution device 20 has a storage unit (a memory) that is different from the display-program storage unit 25 for temporarily storing video information received from the ground station 51. Although video information is explained based on analog data, it is needless to mention that the present invention can be also applied to digital data.

(System Operations)

Figure 4:
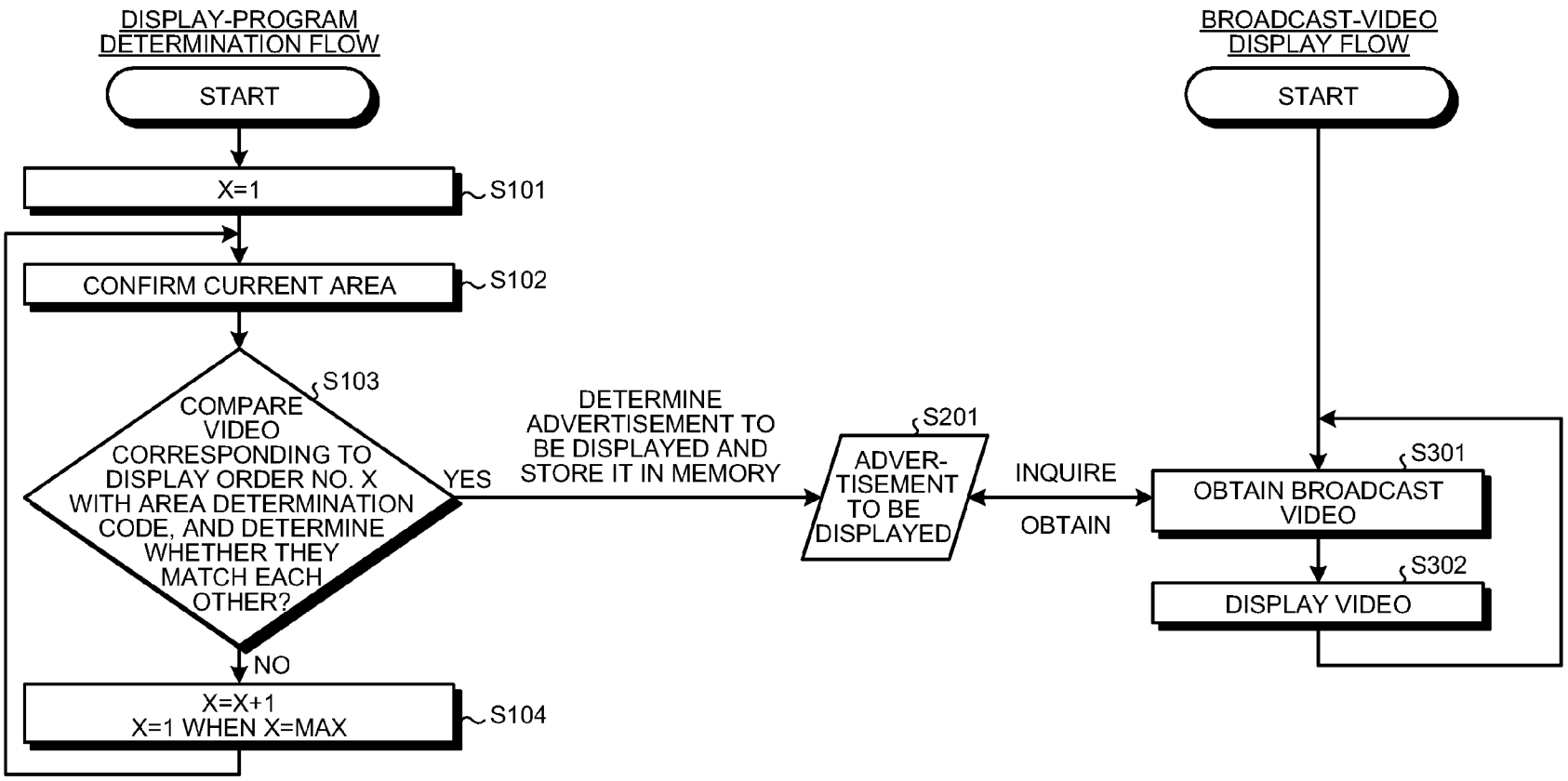
FIG. 4 is a flowchart of a display-program determination flow and a broadcast-video display flow in the train-mounted video information distribution and display system according to the present embodiment.

Operations of the train-mounted video information distribution and display system according to the first embodiment are explained next with reference to FIGS. 2 to 6. FIG. 4 is a flowchart of a display-program determination flow and a broadcast-video display flow in the train-mounted video information distribution and display system according to the present embodiment, FIG. 5 is an example of a program table as one of pieces of the reference information described above, and FIG. 6 is an explanatory diagram of a concept of an area determination performed based on the program table shown in FIG. 5.

Figures 5, 6:
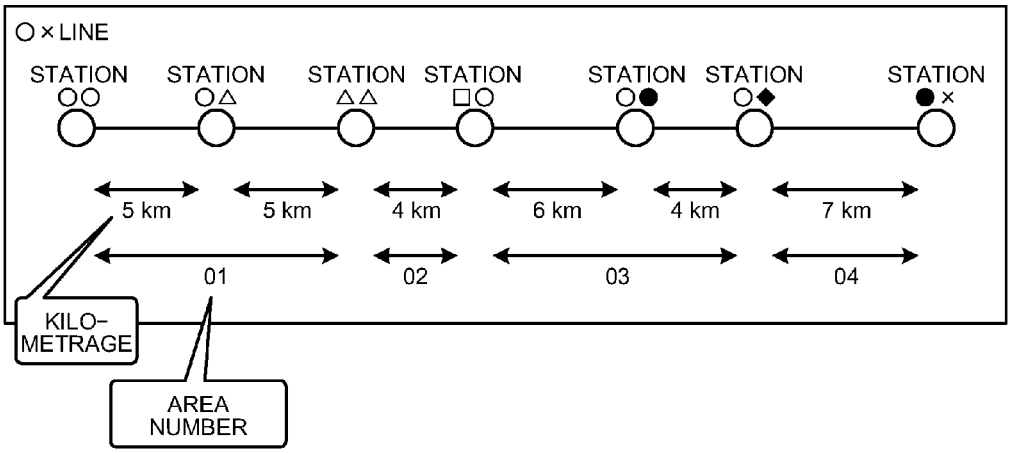
FIG. 5 is an example of a program table as one of pieces of reference information.
FIG. 6 is an explanatory diagram of a concept of an area determination performed based on the program table shown in FIG. 5.

For example, as shown in the program table in FIG. 5, an order of displayed (X) and an advertisement video name are related to each other in advance, and the advertisement video name is also related to an area determination code. That is, a certain advertisement video is set with an order of displayed among other advertisement videos and this advertisement video, and this video is repeatedly displayed in a running section that is assigned by an area determination code. A concept of an area that is defined by an area determination code is as shown in FIG. 6, for example. In the example of FIG. 6, "area number 01" is set to an area between "station ○○" and "station ΔΔ".

Referring back to FIG. 4, in the display-program determination flow in this drawing, the display-program determining unit 21 first sets a variable X (see FIG. 5) that shows an order of displayed at an initial value (X=1 in the example of FIG. 4) (Step S101), and confirms a current running area in which a train is running (Step S102). Next, the display-program determining unit 21 compares a video that corresponds to an order of displayed (No. X) with an area determination code, and determines whether the video matches the area determination code (Step S103). When the video matches the area determination code (YES at Step S103), the display-program determining unit 21 determines that the video is an advertisement to be displayed, and stores this video in the display-program storage unit 25 (Step S201). On the other hand, when the order of displayed does not match the area determination code (NO at Step S103), the display-program determining unit 21 increments a value of X (X=1 when X=MAX) (Step S104), and repeats processes of Steps S102 to S104.

Meanwhile, the distribution control unit 22 confirms with the display-program determining unit 21 whether an advertisement video is stored in the display-program storage unit 25. When an advertisement video is stored, the distribution control unit 22 obtains this advertisement video (Step S301) and displays this video (Step S302), and also repeatedly performs processes of Steps S301 and S302. In the flow in FIG. 4, the distribution control unit 22 confirms with the display-program determining unit 21 whether an advertisement video is stored in the display-program storage unit 25. Alternatively, the distribution control unit 22 can always obtain a video stored in the display-program storage unit 25 and repeatedly display the obtained video, without confirming with the display-program determining unit 21. In the case of this controlling process, a process of the broadcast-video display flow is performed independently of the display-program determination flow.

When a process flow in FIG. 4 is performed, the following process is performed in the program table shown in FIG. 5 as an example. First, in "area 01" between the "station ○○" and the "station ΔΔ", advertisement videos of a company A and a company B are repeatedly broadcast such as "company A"→"company B"→"company A"→"company B", . . . . In "area 02" between the "station ΔΔ" and "station □○", an advertisement video of a company C is repeatedly broadcast such as "company C"→"company C"→"company C"→, . . . . Thereafter, similarly, in "area 03" between the "station □○" and "station ○●", an advertisement video of a company D is repeatedly broadcast. In "area 04" between the "station ○●" and "station ●x", advertisement videos of a company E and a company F are repeatedly broadcast.

Area determination codes in the program table in FIG. 5 can be arbitrarily set without giving any influence to contents of advertisement videos of the companies, and can be arbitrarily changed by performing a remote transmission from a way side to the train side. Therefore, the maintainability and serviceability of the system can be improved. Further, even when there is a change request of a display section of an advertisement video from a sponsor side, for example, it suffices that only an area determination code that is attached corresponding to an advertisement video concerned is changed. Therefore, it is possible to promptly respond to a need of the sponsor side.

As is also shown in the process of the display-program determination flow in FIG. 4, regarding video information stored in the display-program storage unit 25, video information that corresponds to a new display area is automatically stored at a point of time when a display area is changed. Therefore, a new program table can be easily generated without performing any complicated controlling process.

As is also shown in the process of the display-program determination flow in FIG. 4, the distribution control unit 22 can obtain and broadcast video information (broadcast information) stored in the display-program storage unit 25, regardless of the process of the display-program determining unit 21. Therefore, the distribution control unit 22 can obtain and broadcast a video being output to the display-program storage unit 25, that is, video information that is currently in the middle of being output and the whole of which is not yet completely output. Consequently, even when an area changes while a train runs, the display-program determining unit 21 outputs an advertisement video corresponding to a new area determination code to the display-program storage unit 25, and at the same time, the distribution control unit 22 takes out information stored in the display-program storage unit 25 and displays this video. As a result, an advertisement video can be continuously displayed without an unnatural interruption of the video, even when an area is switched.

Figures 7, 8:
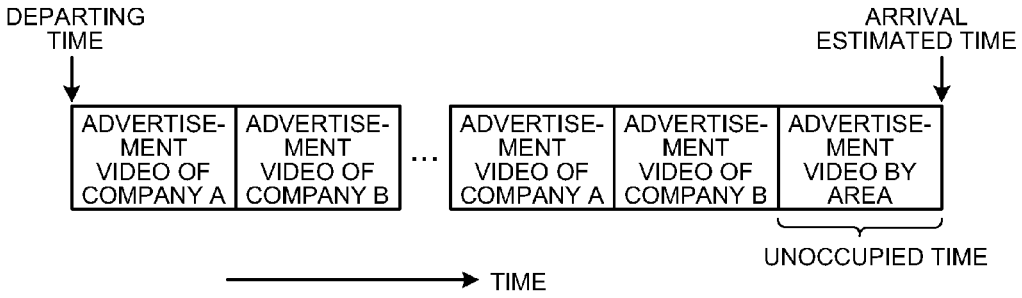
FIG. 7 is an example of a case of broadcasting another advertisement video by using an unoccupied time.
FIG. 8 is an example of a determination table for determining an area number by using only kilometrage.

According to a method described above, in a section that is set as the "area 01" between the "station ○○" and the "station ΔΔ", for example, the advertisement videos of the company A and the company B are repeatedly broadcast. A slight unoccupied time occurs depending on a relationship between a distance between the stations and broadcast times of the advertisement videos of both companies. FIG. 7 is an example of a case of broadcasting another advertisement video by using the unoccupied time.

In FIG. 7, an occupied time within the area 01 can be calculated by using an arrival estimated time of a train that is obtained through the train information device 10. The display-program determining unit 21 can broadcast an advertisement video relevant to the area of the "area 01", for example, by using this unoccupied time. This method is based on a concept that a display program is generated in advance, and not based on a concept that an interruption process and a priority process as described above in Patent Document 1 are performed. Therefore, a time position for a display does not need to be the last of a broadcast time, and can be inserted after an end of broadcasting a video of each company during a broadcast time of the company A and the company B that is repeatedly broadcast. Because an unoccupied time of a broadcast time changes depending on a distance of an area section and a broadcast time of an advertisement video of each company, regarding advertisement videos to be inserted, videos that have various lengths such as a video of a short broadcast time, a video of an intermediate broadcast time, and a video of a long broadcast time, for example, can be prepared in advance. With this configuration, a display program in which a broadcast time is effectively used can be generated.

Furthermore, in the present embodiment, a display program is determined based on an area determination code that corresponds to an area number at one to one. Various methods are considered for determining an area number that assigns a running area. Details are explained in the following embodiments. Area numbers are set to determine "segmentation" for determining in which running sections many "advertisement videos" should be displayed. Hereinafter, information ("segmentation information") that is necessary for this segmentation is called "status".

As explained above, according to the train-mounted video information distribution and display system in the present embodiment, the distribution control unit 22 sequentially reads out and distributes to the display device 40 display programs that include one or more pieces of video information which are determined based on segmentation information for assigning a predetermined section within a running section of a train. Therefore, in the predetermined section, the determined one or more pieces of video information are repeatedly displayed. Consequently, the advertising effect of advertisement videos to be broadcast in the train can be increased, and reduction of the maintainability and serviceability can be suppressed.

Second Embodiment

In a second embodiment, an example of switching advertisement videos based on information of "kilometrage" is explained. That is, in the present embodiment, an example of using "kilometrage" as the "status" mentioned above is explained.

FIG. 8 is an example of a determination table for determining an area number by using only kilometrage. This determination table is also one of pieces of the reference information. According to FIG. 8, a section of kilometrage of "0 to 10 kilometers (km)" is set at an area number "01", that of kilometrage of "10 to 14 km" is set at an area number "02", that of kilometrage of "14 to 24 km" is set at an area number "03", and that of kilometrage of "24 to 31 km" is set at an area number "04", for example.

An advantage of determining an area number by using only kilometrage is that this method is effective for a long-distance train such as Shinkansen bullet train, for example. In the case of a long-distance train, a process can be simplified by determining an area number by using kilometrage because the number of stopping stations is small. Although the example shown in FIG. 8 uses a determination table in which kilometrage between stations is a unit, the kilometrage between stations does not need to be a unit, and an area number can be also determined based on a determination table in which a total operating distance is segmented in a unit of 20 km, for example.

Third Embodiment

In the train-mounted video information distribution and display system according to the second embodiment, an example of using the "kilometrage" as the "status" to switch an advertisement video has been explained. In a third embodiment, an example of using information of the "last station (the station stopped immediately before)" and the "next station (the next stopping station)" as the "status" is explained. It is needless to mention that the present embodiment can be combined with each of the first and second embodiments.

FIG. 9 is an example of a determination table for determining an area number by using information of a last station and a next station. This determination table is also a piece of the reference information described above. According to FIG. 9, an area between the "station ○○" and the "station ΔΔ" is set at an area number "01". Thereafter, an area between the "station ΔΔ" and the "station □○" is set at an area number "02". An area between the "station Do" and "station ○◆" is set at an area number "03". An area between the "station of" and the "station ●x" is set at an area number "04", for example.

An advantage of determining an area number by using the information of a last station and a next station is that this method is effective when there is a station where a limited express train, an express train, and a rapid train (hereinafter, "limited express train and the like") do not stop.

When the determination table as explained in the present embodiment is provided, when there is an advertisement video relevant to only a non-stopping station, for example, this advertisement video can be skipped. By skipping such an advertisement video not relevant to a stopping station, advertisement videos in hand can be effectively used within a limited time and space. When such a determination table is held uniformly and also when a determination table is used for each limited express train and the like and for each station that stops at each station, it is not necessary to distinguish an advertisement video itself and a mode of the system between a limited express train and a train that stops at each station. Consequently, the maintainability and serviceability of the system can be improved.

Fourth Embodiment

In the train-mounted video information distribution and display system according to the third embodiment, an example of using information of the "last station (the station stopped immediately before)" and the "next station (the next stopping station)" as the "status" has been explained. In a fourth embodiment, an example of using the number of passengers as the "status" is explained. It is needless to mention that the present embodiment can be combined with each of the first to third embodiments.

FIG. 10 is an example of a determination table in which information of the "number of passengers" is used as the status. This determination table is also a piece of the reference information described above. The information of the number of passengers can be obtained through the train information device 10. According to FIG. 10, a segmentation number is set at "01" when the number of passengers is "equal to or smaller than 20". Thereafter, the segmentation number is set at "02" when the number of passengers is "20 to 50", the segmentation number is set at "03" when the number of passengers is "50 to 80", the segmentation number is set at "04" when the number of passengers is "80 to 100", the segmentation number is set at "05" when the number of passengers is "100 to 120", and the segmentation number is set at "06" when the number of passengers is "equal to or larger than 120", for example.

The segmentation information that is determined by using the information of the number of passengers can be used as the information for selecting an advertisement video to be inserted into an unoccupied time, for example. For example, when the number of passengers is equal to or larger than a certain number and is also equal to or smaller than a certain number, it means there are an appropriate number of passengers who watch the advertisement video. In this state, the advertisement video can be watched easily so that an advertising effect can be expected. Therefore, among advertisement videos to be inserted into an unoccupied time, an advertisement video of which advertizing fee is high can be displayed with a priority (generates a program table for displaying with a priority an advertisement video of which advertising fee is high).

When a determination table as explained in the present embodiment is held, it is possible to rightly respond to diversified needs of users. A specific effect of advertisement videos can be further increased.

Fifth Embodiment

In the train-mounted video information distribution and display system according to the fourth embodiment, an example of using the number of passengers as the "status" has been explained. In a fifth embodiment, an example of using information of "temperature" as the "status" is explained. It is needless to mention that the present embodiment can be combined with each of the first to fourth embodiments.

FIG. 11 is an example of a determination table in which information of "temperature" is used as the status. This determination table is also a piece of the reference information described above. The temperature information can be obtained through the train information device 10. According to FIG. 11, a segmentation number is set at "01" when the temperature is "equal to or lower than −10° C.". Thereafter, the segmentation number is set at "02" when the temperature is "−10 to 0° C.", the segmentation number is set at "03" when the temperature is "0 to 10° C.", the segmentation number is set at "04" when the temperature is "10 to 20° C.", the segmentation number is set at "05" when the temperature is "20 to 30° C.", and the segmentation number is set at "06" when the temperature is "equal to or higher than 30° C.", for example.

The segmentation information that is determined by using the temperature information can be used as the information for selecting an advertisement video to be inserted into an unoccupied time, for example. When the temperature is high, for example, an advertisement concerning a cooling apparatus or a cold cake can be inserted as an advertisement video that uses an unoccupied time. On the other hand, when the temperature is low, an advertisement concerning a heating device or food information such as noodles can be inserted.

When a determination table as explained in the present embodiment is held, advertisement videos in hand can be effectively used within a limited time and space. When video information is within a range of a storage capacity of the video-information storing unit 24, it is not necessary to provide a maintenance service of changing video information at each change of the season. Consequently, the maintainability and serviceability of the system can be improved.

Although an example of using information of the "temperature" as the "status" has been explained in the present embodiment, information other than the "temperature" can be also used as the "status", such as "humidity (high/medium/low)", "weather (rainy/sunny)", "occupancy rate (high/medium/low)", "time (morning/noon/evening)", "car number (women-only car/others, weakly air-conditioned car/others, nonsmoking car/smoking car, a plural-car unit (such as first to fifth cars/sixth to tenth cars/tenth to fifteenth cars), "day of the week (weekdays/Saturdays and holidays)", "type of train (limited express/local)", and "destination (urban area/suburbs)". When this information is combined the above embodiments, it becomes possible to rightly respond to diversified user needs.

INDUSTRIAL APPLICABILITY

As described above, the train-mounted video information distribution and display system and the display switching method thereof according to the present invention are useful as an invention capable of sufficiently increasing an advertising effect of advertisement videos to be broadcast in a train.

The invention claimed is:

1. A train-mounted video information distribution and display system comprising:

a display device that displays a plurality of pieces of video information as advertisement videos on a display device in a train based on train information of a given train that is obtained from a train information device mounted in the train;

a display-program determining unit that extracts one or more pieces of video information from the pieces of video information and determines a display program to be displayed on the display device;

a video-information storing unit that holds the video information and reference information that is necessary to determine the display program;

a display-program storage unit that receives a display program which is determined by the display-program determining unit from the video-information storing unit, and holds a received display program; and a distribution control unit that sequentially reads out display programs stored in the display-program storage unit and distributes the read display programs to the display device, wherein the display program includes one or more pieces of video information that are determined based on segmentation information for assigning a predetermined section within a running section of the train, and the determined one or more pieces of video information are repeatedly displayed in the predetermined section, and wherein the distribution control unit is configured to change the pieces of video information that are displayed on the display device in the train when the train moves from one predetermined section to another within the running section of the train.

2. The train-mounted video information distribution and display system according to claim 1, wherein as the reference information, the system includes a reference table that defines a correspondence relationship between an area determination code that corresponds at one to one to an area number for identifying the predetermined section, video information to be displayed in a section that is identified by the area number, and an order for displaying the video information.

3. The train-mounted video information distribution and display system according to claim 2, wherein the area number is determined based on kilometrage information.

4. The train-mounted video information distribution and display system according to claim 2, wherein the area number is determined based on stopping-station information.

5. The train-mounted video information distribution and display system according to claim 2, wherein the system displays video information of which types are different from those of the pieces of video information that are assigned by the area determination code, by using an unoccupied time within a broadcast time of video information that is repeatedly displayed in the predetermined section.

6. The train-mounted video information distribution and display system according to claim 5, wherein video information that is broadcast by using the unoccupied time is provided with the area determination code based on information of number of passengers.

7. The train-mounted video information distribution and display system according to claim 5, wherein video information that is broadcast by using the unoccupied time is provided with the area determination code based on temperature information.

8. The train-mounted video information distribution and display system according to claim 1, wherein video information stored in the video-information storing unit is transmitted from a connected external device.

9. The train-mounted video information distribution and display system according to claim 1, wherein reference information stored in the video-information storing unit is transmitted from a connected external device.

10. The train-mounted video information distribution and display system according to claim 9, wherein the reference information is changed through a connected external device.

11. A display switching method of a train-mounted video information distribution and display system, the system comprising:

a display device that displays a plurality of pieces of video information as an advertisement video based on train information of a given train that is obtained from a train information device mounted in a train; and a video-information storing unit that holds reference information that is necessary to determine a display program that includes a plurality of pieces of video information to be displayed on the display device and one or more pieces of video information extracted from the pieces of video information, wherein the method comprises:

a display-program determining step of extracting one or more pieces of video information from the pieces of video information and determining a display program for displaying the extracted video information on the display device;

a distribution controlling step of distributing a display program that is determined at the display-program determining step to the display device, and the display program includes one or more pieces of video information that are determined based on segmentation information for assigning a predetermined section within a running section of a train and that are repeatedly displayed in the predetermined section; and changing the pieces of video information that are displayed on the display device in the train when the train moves from one predetermined section to another within the running section of the train.

* * * * *